United States Patent [19]

Clayson

[11] Patent Number: 4,471,696

[45] Date of Patent: Sep. 18, 1984

[54] HIGH EXPLOSIVE PROJECTILE FUZING

[75] Inventor: Arthur E. Clayson, Inyokern, Calif.

[73] Assignee: The United States of America as represented by the Secretary of the Navy, Washington, D.C.

[21] Appl. No.: 440,787

[22] Filed: Nov. 12, 1982

[51] Int. Cl.[3] ..... F42C 19/00; F42C 19/02

[52] U.S. Cl. ..... 102/200; 102/293

[58] Field of Search ..... 102/200, 293, 272; 89/1 A

[56] References Cited

U.S. PATENT DOCUMENTS

| | | | |
|---|---|---|---|
| 1,531,716 | 3/1925 | Remondy | 102/272 |
| 2,812,714 | 11/1957 | Wheatley et al. | 102/235 |
| 2,962,968 | 12/1960 | Neuwirth, Jr. et al. | 102/245 |
| 3,205,822 | 9/1965 | Gustafsson et al. | 102/200 |
| 3,961,578 | 6/1976 | Popovitch | 102/242 |

*Primary Examiner*—Charles T. Jordan

*Attorney, Agent, or Firm*—Robert F. Beers; W. Thom Skeer

[57] ABSTRACT

An adaptor housing is configured to hold a sub-diameter fuze mechanism on a conventional projectile.

6 Claims, 1 Drawing Figure

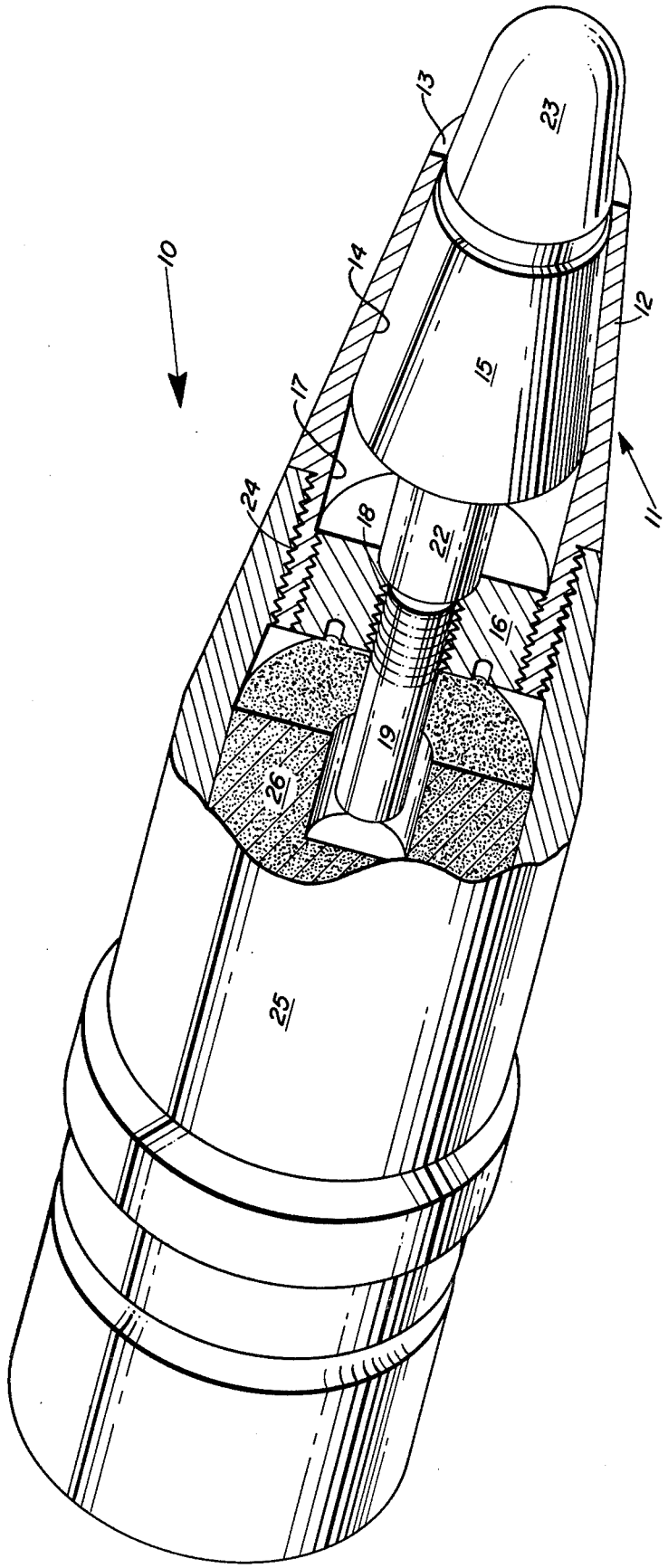
10
11
12
13
14
15
16
17
18
19
22
23
24
25
26

HIGH EXPLOSIVE PROJECTILE FUZING

BACKGROUND OF THE INVENTION

1. Field of the Invention

This invention relates to the field of ordnance. More particularly, this invention relates to the field of aerial projectiles. In still greater particularity, this invention relates to the fuzes for aerial projectiles. In still greater particularity, but without limitations thereto, the invention will be described as it pertains to a fuze which is usable on two different calibers of aerial projectiles.

2. Description of the Prior Art

The field of fuzing conventional projectiles is well established and a wide variety of fuzing systems are available. Large diameter high explosive rounds used for air-to-air combat are fuzed to explode after a short interval of contact. This permits these rounds to enter a relatively soft skinned aircraft and explode on the interior thereof inflicting maximum damage. When such rounds are used in an air-to-ground combat situation a serious safety condition exists and an adverse impact on the successful operation of the projectile is present. In such situations, projectiles ricochet from roadways and soft ground to bounce in the air and explode. These aerial explosions upon ricochet are detrimental to the launching aircraft and prevent close engagement and low altitude operation.

Prior fuzing of smaller diameter, e.g. 20 mm, projectiles explode on contact but the smaller rounds are less effective against modern, heavier armor. It would be highly desirable to use the larger diameter rounds in the air-to-ground operation due to their greater kinetic energy and higher explosive charges.

BRIEF DESCRIPTION OF THE INVENTION

The invention overcomes the afore-stated disadvantages of the prior art structures by providing a fuze assembly which may be used on the larger diameter projectiles by installing a conventional 20 mm fuze and a housing adapted for replacement of the large diameter fuze. Additionally, the construction is such that only a single fuze need be stocked for both diameter projectiles and change from one diameter to the other is a simple mechanical assembly easily performed by armorers.

Accordingly, it is an object of this invention to provide an improved fuze assembly.

Another object of this invention is to provide a fuze assembly which may be employed on large diameter projectiles for air-to-ground combat missions.

A still further object of this invention is to provide a fuze assembly which by means of simple mechanical disassembly may be utilized on more than a single projectile.

These and other objects of the invention will become apparent to those skilled in the art in reading the following specification and claims and inspection of the drawing.

BRIEF DESCRIPTION OF THE FIGURES

The single figure is a perspective view of the fuze assembly of the invention with portions broken away for clarity of description

DESCRIPTION OF THE PREFERRED EMBODIMENT

Referring to the figure, a projectile 10 has an housing 11 on the forward portion thereof with an external surface 12 which continues the ballistic ogive of projectile 10 and terminates in an open nose portion 13. Housing 12 has a longitudinal aperture extending therethrough having an internal surface 14 which is configured to correspond to the ogive configuration of a conventional point detonation fuze 15. A base closure member 16 is threadably received in a internal cylinderical surface 17 of the internal bore of housing 11 to engage fuze 15.

Base closure 16 has an internal aperture 18 which threadably receives a booster charge 19. Booster charge 19 is a conventional charge for large diameter projectile 10 and in converting large diameter projectile 10 for the new fuze of the invention. Booster charge 19, sometimes termed relay charge, may be salvaged from the incorrectly fuzed large diameter projectile. Closure member 16 urges booster charge 19 to be in contact with the base 22 of conventional fuze 15 where it may be ignited thereby in the conventional fashion. In this assembled position, base closure 16 presses against base 22 of fuze 15 and forces the ogival surfaces into contact with the internal bore 14 such that a nose 23 of conventional fuze 15 protrudes from opening 13. In this configuration, the conventional point detonating mechanism of fuze 15 is exposed and is operated in the conventional fashion.

Although a variety of fuzes and different shell diameters may be used in the practice of the invention, the developmental models used a conventional fuze for a 20 mm projectile, the Mark 78, Mod 2, and housing 11 was configured to fit on a ADEN 30 mm high explosive projectile. Housing 11 was made of an aluminum alloy as was base closure 16.

Housing 11 has a rearward extending portion 24 which is threaded to fit within shell casing 25. This threaded relationship is conventional in the projectile arts. In this position, the booster charge 19 extends rearwardly from closure 16 into the high explosive charge 26 of projectile 10. Likewise, this positioning is conventional.

The foregoing description taken together with the appended claims constitute a disclosure such as to enable a person skilled in the metal fabrication and ordnance arts and having the benefit of the teachings contained therein to make and use the invention. Further, the structure herein described meets the objects of invention, and generally constitutes a meritorous advance in the art unobvious to such an artsian not having the benefit of these teachings.

I claim:

1. A fuze assembly comprising:

a housing having, an external surface configured to a predetermined first ogive corresponding to a projectile having a first diameter, an open nose, an internal bore communicating with said open nose and having a first wall surface configured to a predetermined second ogive corresponding to a projectile having a second diameter smaller than said first diameter, and a second wall surface which is cylinderical communicating with said first wall surface remote from said open nose;

a fuze having a base, a nose portion, and an outer surface which is configured to said predetermined second ogive, said fuse being placed in the internal bore such that its outer surface is in contact with the first wall surface of said internal bore with its nose portion extending through the open nose of said housing;

a base closure attached to said housing and extending into said internal bore contacting said second wall surface and said base of said fuze to secure said fuze in said housing.

2. A fuze assembly according to claim 1 further including a booster charge effectively held by said base closure to be in contact with said base of said fuze.

3. A fuze assembly according to claim 1 wherein said housing has an external surface remote from said open nose configured to fit a projectile of said first diameter.

4. A fuze assembly according to claim 1 where said base closure has a bore extending therethrough which is configured to be concentri with said internal bore of said housing.

5. A fuze assembly according to claim 4 wherein said housing has an external surface remote from said open nose configured to fit a projectile of said first diameter.

6. A fuze assembly according to claim 4 further including a booster charge extending through said bore of said base closure and positioned thereby to be in operative relation to the base of said fuze to be ignited thereby.

* * * * *